US010801396B2

(12) United States Patent
Groskopf et al.

(10) Patent No.: US 10,801,396 B2
(45) Date of Patent: Oct. 13, 2020

(54) MIXTURE-LUBRICATED FOUR-STROKE ENGINE

(71) Applicant: Andreas Stihl AG & Co. KG, Waiblingen (DE)

(72) Inventors: Gordon Groskopf, Stuttgart (DE); Manuel Dangelmaier, Wernau (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/249,693

(22) Filed: Jan. 16, 2019

(65) Prior Publication Data

US 2019/0218961 A1 Jul. 18, 2019

(30) Foreign Application Priority Data

Jan. 17, 2018 (DE) ..... 10 2018 000 340

(51) Int. Cl.
*F02B 33/26* (2006.01)
*F01M 3/00* (2006.01)
*F02B 33/30* (2006.01)

(52) U.S. Cl.
CPC ..... *F02B 33/26* (2013.01); *F01M 3/00* (2013.01); *F02B 33/30* (2013.01)

(58) Field of Classification Search
CPC ..... F02B 33/26; F02B 33/30; F02B 63/02; F02B 2075/027; F01M 3/00; F01M 1/04
See application file for complete search history.

(56) References Cited

U.S. PATENT DOCUMENTS 6,220,216 B1 * 4/2001 Haberlein ..... F01M 1/06 123/196 R
6,659,064 B1 * 12/2003 Massmann ..... F01M 3/00 123/196 R
7,398,759 B2 * 7/2008 Todero ..... F01L 3/205 123/317
2002/0026920 A1 3/2002 Durr et al.
2002/0029767 A1 * 3/2002 Haberlein ..... F02M 17/04 123/495

FOREIGN PATENT DOCUMENTS

WO WO-9964734 A1 * 12/1999 ..... F02B 33/12

* cited by examiner

*Primary Examiner* — Jacob M Amick
*Assistant Examiner* — Charles Brauch
(74) *Attorney, Agent, or Firm* — Walter Ottesen, P.A.

(57) ABSTRACT

A mixture-lubricated four-stroke engine has a cylinder and a piston. On the piston, at least one piston ring is arranged. Between valve drive chamber and crankcase interior, at least one first channel is arranged. The first opening of the first channel lies in the bottom dead center position of the piston below each piston ring. At the first opening, the first channel defines a first middle flow direction for mixture flowing into the crankcase interior. The first middle flow direction extends inclined towards the combustion chamber and in a viewing direction perpendicular to the cylinder longitudinal plane intersects the longitudinal center axis above the first opening of the first channel.

16 Claims, 13 Drawing Sheets

MIXTURE-LUBRICATED FOUR-STROKE ENGINE

CROSS REFERENCE TO RELATED APPLICATION

This application claims priority of German patent application No. 10 2018 000 340.0, filed Jan. 17, 2018, the entire content of which is incorporated herein by reference.

BACKGROUND OF THE INVENTION

From US 2002/0026920 A1 a mixture-lubricated four-stroke engine is known, in which in the cylinder wall a through bore is formed. The first open end of the through bore is located at the height of the piston in the cylinder working surface standing at the bottom dead center, and the second open end opens into the cam space. Because of this, the crankcase interior and the cam chamber are flow-connected. Oil scraped off the cylinder wall by the piston rings is transported from the crankcase along the through bore into the cam chamber. Because of this, good lubrication of the cam drive is ensured even at high rotational speeds.

In particular at high rotational speeds, mixture-lubricated four-stroke engines are subjected to major loads. These major loads can result in premature wear manifestations on moving parts in the crankcase of the mixture-lubricated four-stroke engine, in particular when a lack of lubricating oil occurs.

SUMMARY OF THE INVENTION

It is an object of the invention to further develop a mixture-lubricated four-stroke engine in such a manner that an adequate lubricating oil supply of the moving parts in the crankcase is ensured.

This object can, for example, be achieved via a mixture-lubricated four-stroke engine having the features of: a cylinder; a piston; at least one piston ring arranged on the piston; the cylinder and the piston conjointly delimiting a combustion chamber; a piston pin; a crankpin; a connecting rod mounted on the piston pin and the crankpin; a crankcase defining a crankcase interior; a crankshaft arranged in the crankcase interior and defining a crankshaft axis; the piston being configured to drive the crankshaft via the connecting rod; an inlet valve; an outlet valve; a valve control for the inlet valve and the outlet valve; the crankshaft being configured to drive the valve control for the inlet valve and the outlet valve; a mixture preparation unit; an intake channel; the inlet valve being connected to the mixture preparation unit via the intake channel; a valve drive chamber; the crankcase interior being flow-connected to the intake channel via the valve drive chamber; at least one first channel being part of the flow-connection and being arranged between the valve drive chamber and the crankcase interior; the at least one first channel defining a first opening which opens into the crankcase interior and a second opening which opens into the valve drive chamber; the cylinder having a cylinder bore defining a longitudinal center axis; the longitudinal center axis and the crankshaft axis conjointly defining a cylinder longitudinal plane; the piston having a bottom dead center position; the first opening of the at least one first channel lying below each of the at least one piston ring in the bottom dead center position of the piston; the at least one first channel, at the first opening, defining a first middle flow direction for mixture flowing into the crankcase interior; and, the first middle flow direction extending inclined towards the combustion chamber and, in a viewing direction perpendicular to the cylinder longitudinal plane, intersecting the longitudinal center axis above the first opening of the at least one first channel.

It is provided that the piston via a connecting rod drives a crankshaft arranged in a crankcase interior of a crankcase. The crankcase interior is the space that is substantially enclosed by the crankcase. The crankshaft drives a valve control for an inlet valve and an outlet valve. The crankcase interior is flow-connected to the intake channel via a valve drive chamber. Between the valve drive chamber and the crankcase interior, at least one first channel is arranged, wherein a first opening of the first channel opens into the crankcase interior and a second opening of the first channel opens into the valve drive chamber. With each stroke of the piston, it is ensured that the fuel/air mixture is delivered from the intake channel into the crankcase interior. The fuel/air mixture contains oil and also serves as lubricant. When the piston moves in the direction of its top dead center, a negative pressure is created in the crankcase interior. Because of the negative pressure in the crankcase interior, mixture, emanating from the intake channel, flows through the valve drive chamber and from the valve drive chamber via the at least one channel into the crankcase interior.

The cylinder of the four-stroke engine includes a cylinder bore with a longitudinal center axis. The four-stroke engine includes a cylinder longitudinal plane which is defined by the longitudinal center axis and a rotational axis of the crankshaft. In the bottom dead center position of the piston, the first opening of the first channel lies below each piston ring of the piston. At the first opening, the first channel defines a first middle flow direction for mixture flowing into the crankcase interior. The first middle flow direction extends inclined towards the combustion chamber and in a viewing direction perpendicular to the cylinder longitudinal plane intersects the longitudinal center axis above the first opening of the first channel. Emanating from the first channel, "top" is to mean in the direction towards the combustion chamber and "bottom" in the direction towards the crankshaft longitudinal axis. The first middle flow direction corresponds to a straight line which is approximated to a center line of the first channel and intersects a center point of the first opening of the first channel. The center line of the first channel corresponds to the centroids of the sectional areas of the first channel in planes which stand perpendicularly relative to the rotational axis. Along the first middle flow direction, mixture flows into the crankcase interior. Advantageously, the first opening of the first channel to the crankcase interior can be at least partly open in the bottom dead center position of the piston.

Because of the position of the first middle flow direction, the moving parts are specifically lubricated by the mixture as lubricant during the operation. In particular the piston, the piston pin and the connecting rod are wetted with mixture as lubricant. Through the targeted orientation of the first middle flow direction via the configuration of the first channel according to an aspect of the invention, the moving parts in the crankcase interior are adequately supplied with lubricant. Because of this, the rate of exchange of the mixture between intake channel and crankcase interior can be reduced. This results in a greater engine output.

Advantageously, in a viewing direction perpendicular to the cylinder longitudinal plane the first middle flow direction can include an angle of maximally 85° with the longitudinal center axis of the cylinder bore. The angle between the first middle flow direction and the longitudinal center axis is open towards the first channel and towards the crankcase and advantageously amounts to maximally 80°, in particular maximally 70°. Advantageously it can be provided that the first middle flow direction in the bottom dead center of the piston extends through the space enclosed by the piston skirt of the piston and intersects the space. On the piston, a piston bottom located facing the rotational axis of the crankshaft is formed. The space enclosed by the piston skirt of the piston is substantially cylindrical in shape, wherein the top of the piston corresponds to the base area of the cylinder shape and the height of the cylinder shape is defined by the maximum distance of the bottom edge of the piston skirt to the piston bottom measured in the direction of the longitudinal center axis. The top of the piston delimits the combustion chamber and faces the combustion chamber. The top of the piston faces away from the crankcase.

Advantageously, the first middle flow direction intersects the piston bottom in the bottom dead center position of the piston. By specifically directing the mixture in the first middle flow direction against the piston bottom, the piston is efficiently cooled and/or lubricated. Because of this, a premature wear because of increased temperatures of the piston and/or increased friction of moving parts can be avoided. Particularly advantageously, the first middle flow direction intersects the piston pin in the top dead center position of the piston. Because of this, the mixture flow is specifically directed at the piston pin. Because of this, an adequate lubricant supply of the piston pin is ensured. A premature wear of the piston pin and of the piston pin bearing can be avoided.

It can advantageously be provided that in at least one piston position a negative pressure is configured in the crankcase interior so that mixture from the intake channel is sucked via the valve drive chamber through the first channel into the crankcase interior. Because of this, an adequate supply of the crankcase interior with lubricant can be ensured.

At the first opening, the first channel has a first opening area which corresponds to the area content of the first opening. Advantageously, the first opening area of the first channel is greater than 5%, preferentially greater than 10%, advantageously greater than 15%, in particular greater than 20% of a cross-sectional area of the cylinder bore standing perpendicularly relative to the longitudinal center axis. The first opening area of the first channel can advantageously be smaller than 10%, in particular smaller than 7% of the cross-sectional area of the cylinder bore. By way of an adequately large first opening area of the first channel it can be ensured that mixture in sufficient quantity flows into the crankcase interior and the supply with lubricant of the moving parts is ensured.

Advantageously, the first channel, starting from the second opening of the first channel, tapers towards the first opening of the first channel. Advantageously, the second opening of the first channel is larger than the first opening of the first channel. Advantageously, the area of the second opening of the first channel is larger than the area of the first opening of the first channel. The tapering of the first channel results in an acceleration of the mixture in the direction of the crankcase interior. Because of this, the flow velocity of the mixture at the first opening of the first channel is greater than at the second opening of the channel. Because of the high inflow velocity into the crankcase interior, mixture flows specifically in the direction of the moving parts on the piston without a premature mixture diffusion or mixture distribution.

Advantageously, the crankcase interior and the valve drive chamber can be flow-connected by a second channel. A first opening of the second channel opens into the crankcase interior. A second opening of the second channel opens into the valve drive chamber. In a viewing direction perpendicular to the cylinder longitudinal plane, the first middle flow direction particularly advantageously encloses an angle of at least 10°, advantageously of at least 20° and in particular of at least 30° with a second middle flow direction at the center point of the first opening of the second channel.

The second middle flow direction corresponds to a straight line which is approximated to a center line of the second channel. The center line of the second channel corresponds to the centroids of the sectional areas of the second channel in planes which stand perpendicularly to the rotational axis of the crankshaft. In the top dead center position of the piston the second middle flow direction advantageously intersects a crankpin of the crankshaft. On the crankpin, the crankshaft is connected to the connecting rod in an articulated manner. Via the second channel, mixture can specifically flow along the second middle flow direction onto moving parts in the crankcase interior so that the same are adequately supplied with lubricant. Moving parts, which are supplied with lubricant via the second channel are in particular, the crankpin, the crankpin bearing and the crankshaft bearings. By using a second channel, the crankcase interior can be specifically supplied with lubricant in different locations so that the rate of exchange of the mixture between intake channel and crankcase interior can be reduced and the engine output is improved.

Advantageously, the second channel, emanating from the second opening of the second channel, tapers towards the first opening of the second channel. Advantageously, the second opening of the second channel can be larger than the first opening of the second channel. Advantageously, the area of the second opening of the second channel can be larger than the area of the first opening of the second channel. The tapering of the second channel results in an acceleration of the mixture in the direction of the crankcase interior. Because of this, the flow velocity of the mixture at the first opening of the second channel is greater than at the second opening of the second channel. Because of the high inflow velocity into the crankcase interior, mixture specifically flows in the direction of the moving parts on the piston without a premature mixture diffusion or mixture distribution.

Advantageously it is provided that the center point of the first opening of the first channel is at a shorter distance from the cylinder longitudinal plane than the center point of the first opening of the second channel. Advantageously, the distance of a crankshaft longitudinal axis, which stands perpendicularly relative to the longitudinal center axis of the cylinder bore and contains the rotational axis of the crankshaft, to the center point of the first opening of the first channel is greater than to the center point of the first opening of the second channel. By spacing the first channel and the second channel, mixture can flow better and more specifically to different locations in the crankcase interior that have to be supplied with lubricant.

Advantageously it is provided that the second middle flow direction in the viewing direction perpendicular to the crankshaft longitudinal plane is inclined relative to the cylinder longitudinal plane in such a manner that the flow of the mixture flowing through the second channel into the crankcase interior has a directional component in the top dead center which is directed against the movement direction of the crankpin. Because of this, the crankpin directly moves through mixture flowing out of the second channel so that the crankpin and in particular also the crankpin bearing are wetted with lubricant.

Advantageously it is provided that in the crankcase between the crankcase interior and the valve drive chamber at least one crankshaft bearing is arranged. The crankshaft bearing is sealed via a seal so that a flow-connection via the crankshaft bearing between the crankcase interior and the valve drive chamber is avoided. By sealing the crankshaft bearing between crankcase interior and valve drive chamber, the pressure equalization between crankcase interior and valve drive chamber is primarily effected via the first channel and/or the second channel. Because of this, the mixture flow through the first and/or the second channel is increased and the moving parts in the crankcase better lubricated.

The crankcase interior and the valve drive chamber can be flow-connected by a third channel, wherein a first opening of the third channel opens into the crankcase interior and a second opening of the third channel opens into the valve drive chamber. By way of the third channel it is possible to better meter or control the mixture fed to the engine elements in the crankcase interior in terms of the quantity and the direction.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
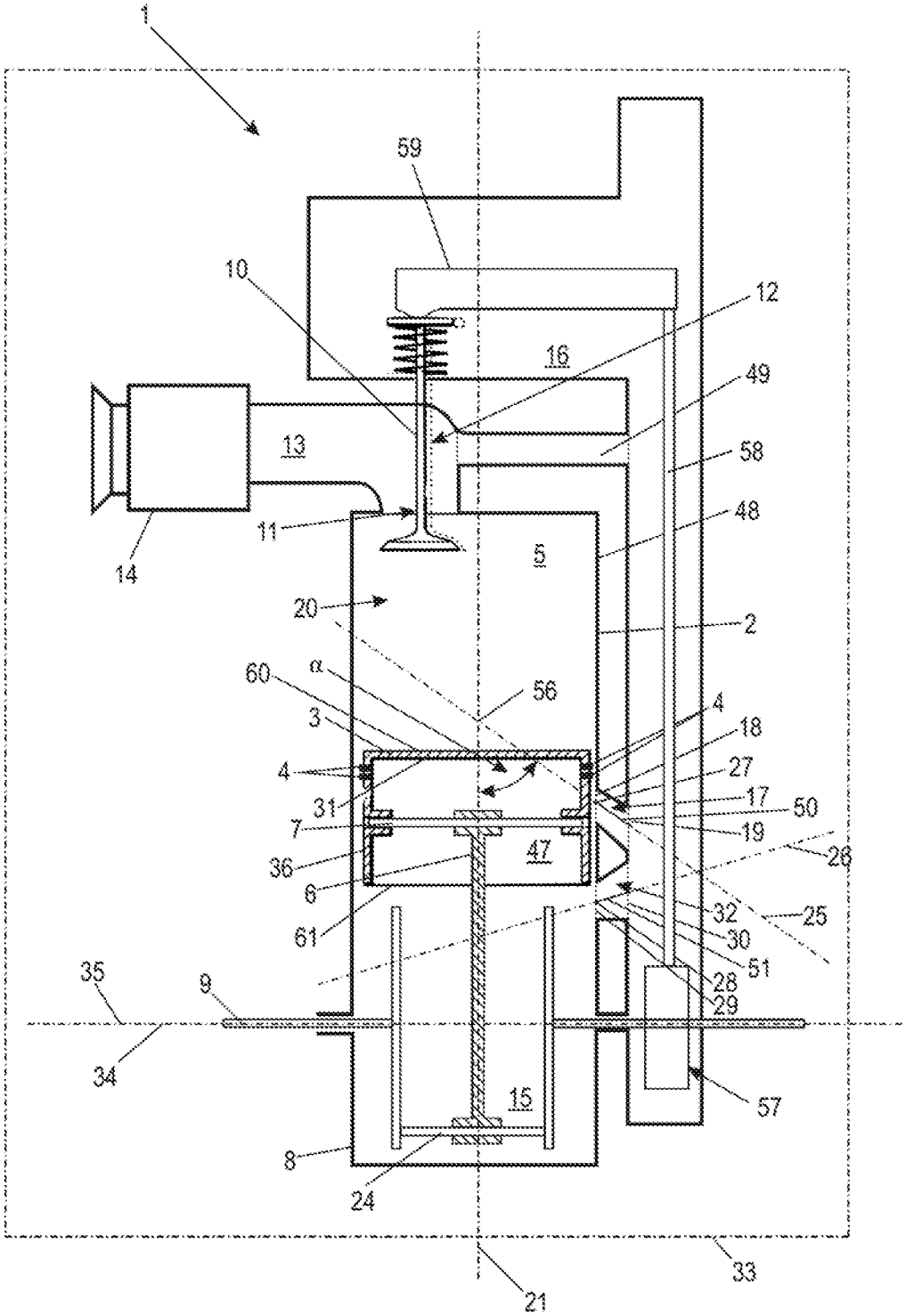
FIG. 1 shows a schematic representation of a mixture-lubricated four-stroke engine with the piston in bottom dead center.

Advantageously, the mixture-lubricated four-stroke engine 1 schematically shown in FIG. 1 is the drive motor in a hand-held work apparatus such as a string trimmer, an angle grinder, a power saw or the like. The four-stroke engine 1 includes a cylinder 2 and a crankcase 8. In the cylinder 2, a cylinder bore 20 is formed which has a longitudinal center axis 21. The circumferential wall of the cylinder bore 20 forms a cylinder working surface 48. The mixture-lubricated four-stroke engine 1 has a piston 3, which is movably arranged in the cylinder 2 in the direction of the longitudinal center axis 21. The cylinder 2 and the piston 3 delimit a combustion chamber 5. Via a connecting rod 6, the piston 3 rotatingly drives a crankshaft 9 which is rotatably mounted in the crankcase 8. The connecting rod 6 is mounted in an articulated manner with one end on a piston pin 7, which is mounted on the piston 3, and with the other end on a crankpin 24 of the crankshaft 9. In FIG. 1, the piston 3 of the four-stroke engine 1 of the embodiment is shown in the vicinity of the bottom dead center (BDC).

The piston 3 is approximately cylindrical in shape. A piston top 60 of the piston 3 corresponds to a base area of the cylinder shape and a piston skirt 36 of the piston 3 corresponds to a lateral area of the cylinder shape. The piston top 60 and the piston skirt 36 delimit a space 47 enclosed by the piston 3. The enclosed space 47 is advantageously cylindrical. The enclosed space 47 can have a base area which corresponds to the piston top 60 and a height which corresponds to the maximum distance between the lower edge 61 of the piston skirt 36 facing away from the piston top 60 and the piston bottom 31 measured in the direction of the longitudinal center axis 21. On the piston 3, a piston bottom 31 is formed. The piston bottom 31 is arranged on the opposite side of the piston top 60 delimiting the combustion chamber 5. On the outside of the piston skirt 36, that is, the surface of the piston skirt 36 directed towards the cylinder working surface 48, at least one piston ring 4, in an advantageous embodiment, at least two piston rings 4, in particular at least three piston rings 4 are arranged. The piston 3 supports itself on the cylinder working surface 48 via the at least one piston ring 4. The at least one piston ring 4 seals the combustion chamber 5 against a crankcase interior 15 of the crankcase 8. In the bottom dead center position of the piston 3, the first opening 18 of the first channel 17 is located below each piston ring 4 of the piston 3 and is at least partly open to the crankcase interior 15.

The combustion chamber 5 is connected to a mixture preparation unit 14 via an inlet valve 11 and an intake channel 13. The mixture preparation unit 14 can for example be a carburetor. Instead of the mixture preparation unit 14, an injection valve for supplying fuel into the intake channel 13 can also be provided. An exhaust channel which is not shown, which preferentially opens into an exhaust muffler which is likewise not shown, leads out of the combustion chamber 5. The connection of the combustion chamber 5 to the exhaust channel is controlled by an outlet valve 12 schematically shown in FIG. 1. Furthermore, the mixture-lubricated four-stroke engine 1 includes a valve control 57, which is merely schematically indicated in FIG. 1, for the inlet valve 11 and the outlet valve 12.

The valve control 57 is arranged in a valve drive chamber 16 and is driven by the crankshaft 9. The valve drive chamber 16 extends from a region through which the crankshaft 9 projects, laterally on the cylinder 2 to as far as the top of the cylinder 2 facing away from the crankcase 8 in a region into which valve stems 10 of the inlet valve 11 and of the outlet valve 12 project. In the embodiment, the valve control 57 actuates a valve stem 10 of the inlet valve 11 and a valve stem 10 of the outlet valve 12 via pushrods 58 and actuation levers 59, of which in FIG. 1 and FIG. 2 one each is shown. The inlet valve 11 and the outlet valve 12 can be driven by the crankshaft 9 of the four-stroke engine 1 alternatively also via a gear drive, a chain drive, a belt drive or in another way instead of via pushrods 58. Instead of the actuation levers 59, control cams for actuating inlet valve 11 and outlet valve 12 are then provided in particular.

The valve drive chamber 16 is flow-connected to the intake channel 13 and the mixture preparation unit 14 via a connecting channel 49. The crankcase interior 15 is flow-connected to the valve drive chamber 16 via at least one first channel 17 and in an advantageous embodiment via at least one second channel 32. Accordingly, the crankcase interior 15 is flow-connected via the first channel 17 and advantageously in addition via the second channel 32 to the valve drive chamber 16, the connecting channel 49, the intake channel 13 and the mixture preparation unit 14. In at least one piston position, such a negative pressure is present in the crankcase interior 15 that mixture is sucked from the intake channel 13 via the connecting channel 49 and the valve drive chamber 16 through the channel 17 and the second channel 32 into the crankcase interior 15. Such a negative pressure is present in particular when the piston 3 is in the upward stroke. The upward stroke can also be described as a movement reducing the combustion chamber 5 in size. During the upward stroke of the piston 3, the volume of the crankcase interior 15 is enlarged so that the pressure in the crankcase interior 15 decreases.

As shown in FIG. 1, the first channel 17 opens into the crankcase interior 15 with a first opening 18. As is likewise shown in FIG. 1, the first channel 17 opens into the valve drive chamber 16 with a second opening 19. In the viewing direction of FIG. 1 perpendicularly to a plane which is defined by a rotational axis 34 of the crankshaft 9 and the longitudinal center axis 21 of the cylinder 2 a center line 50 of the first channel 17 extends from its second opening 19 obliquely upwards to its first opening 18. The center line 50 connects centroids of sectional areas of the first channel 17 in planes standing perpendicularly to the rotational axis 34. The rotational axis 34 is the rotational axis of the crankshaft 9. Here, the terms "top" and "bottom" relate to a position of the four-stroke engine 1 in which the longitudinal center axis 21 of the cylinder 2 is arranged perpendicularly and the combustion chamber 5 is located above the crankcase 8.

When mixture flows through the first channel 17, a flow direction is imposed on the same by the geometry of the first channel 17. At a center point 27 of the first opening 18 of the first channel 17, the mixture during the operation flows in a first middle flow direction 25. The center point 27 is the geometrical center point of the opening 18. The first middle flow direction 25 in this case is a straight line extending through the center point 27 of the first opening 18 of the first channel 17 and which in the embodiment is approximated to the center line 50 of the first channel 17. The first middle flow direction 25 extends in viewing direction perpendicular to a cylinder longitudinal plane 33 emanating from the valve drive chamber 16 through the first channel 17 obliquely upwards in the direction of the combustion chamber 5. Here, the cylinder longitudinal plane 33 is defined by the rotational axis 34 and the longitudinal center axis 21. The first middle flow direction 25 advantageously intersects the longitudinal center axis 21 above the first opening 18 of the first channel 17 in a point of intersection 56.

In a viewing direction perpendicular to the cylinder longitudinal plane 33, the first middle flow direction 25 includes with the longitudinal center axis 21 an angle $\alpha$ of maximally 85°, in an advantageous embodiment of maximally 75°, in particular of maximally 70°. The angle $\alpha$ is open towards the first channel 17 and towards the rotational axis 34. In an advantageous embodiment, the first channel 17 is configured so that the first middle flow direction 25 extends in the bottom dead center of the piston 3 through the space 47 enclosed by the piston 3.

As is shown in FIG. 1, the crankcase interior 15 is flow-connected in an advantageous embodiment to the valve drive chamber 16 via the second channel 32. The second channel 32 opens with a first opening 29 into the crankcase interior 15 and with a second opening 30 into the valve drive chamber 16. The second channel 32 has a center line 51. The second channel 32 is intersected by a parallel plane family, wherein the parallel plane family stands perpendicularly to the rotational axis 34. The planes of the family each form a sectional area in the second channel 32, wherein the sectional areas each have a centroid. The center line 51 connects the centroids of the sectional areas of the second channel 32. In a viewing direction perpendicular to the cylinder longitudinal plane 33 the second channel 32, emanating from the valve drive chamber, extends obliquely downwards into the crankcase interior 15. When mixture flows through the second channel 32, a flow direction is imposed on the same by the geometrical configuration of the second channel 32. At a center point 28 of the first opening 29 of the second channel 32, the mixture, during the operation, flows in a second middle flow direction 26 into the crankcase interior 15. The second middle flow direction 26 predominantly corresponds to a straight line which extends through the center point 28 of the first opening 29 of the second channel 32. In the embodiment, the second middle flow direction 26 is approximated to the center line 51 of the second channel 32. In viewing direction perpendicular to the cylinder longitudinal plane 33, the second middle flow direction 26, emanating from the valve drive chamber 16, extends obliquely downwards into the crankcase interior 15.

Figure 2:
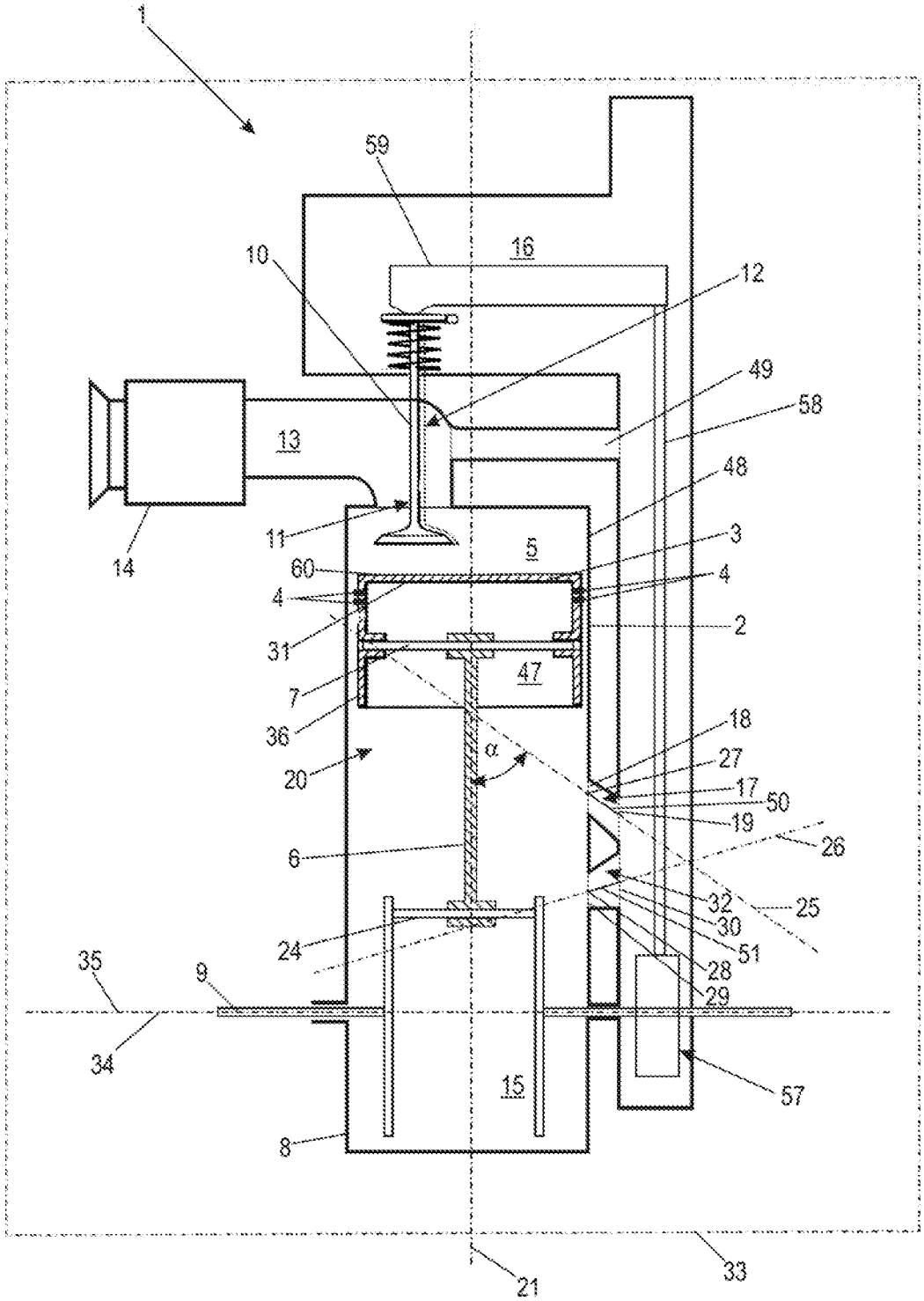
FIG. 2 shows a schematic representation of the mixture-lubricated four-stroke engine from FIG. 1 with the piston in the top dead center.

In FIG. 1, the piston 3 is arranged in the region of its bottom dead center (BDC). In FIG. 2, the four-stroke engine 1 is shown with the piston 3 in the region of the top dead center (TDC). In the top dead center position of the piston 3, the first middle flow direction 25 advantageously intersects the piston pin 7. Because of this, mixture, during the operation, flows in the region of the top dead center of the piston 3 from the valve drive chamber 16 through the first channel 17 into the crankcase interior 15 targeted against the piston pin 7. Because of this, the piston pin 7 and a piston pin bearing 68 (FIG. 9) are supplied with lubricant. In a particularly advantageous embodiment, the second channel 32 is formed so that the second middle flow direction 26 intersects the crankpin 24 in the top dead center position of the piston 3. When mixture flows via the valve drive chamber 16 into the crankcase interior 15 through the second channel 32, the mixture, in the top dead center position of the piston 3, flows directly against the crankpin 24, in particular against the crankpin bearing 67 on the crankpin 24, so that a lubricant supply of the moving parts in the crankcase interior 15 is ensured.

Figure 9:
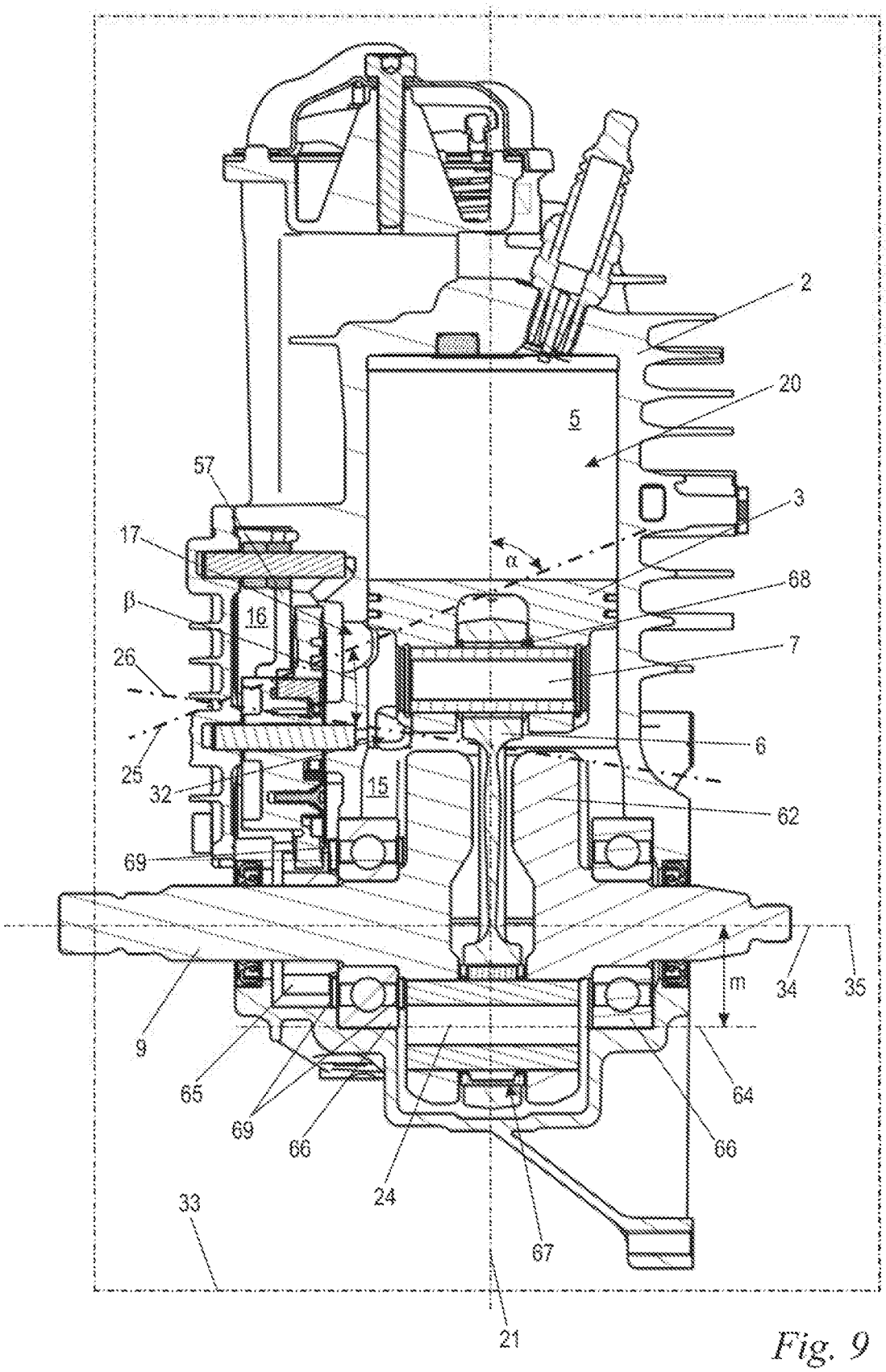
FIG. 9 shows a sectional representation of the mixture-lubricated four-stroke engine with the piston in the bottom dead center.

With opened inlet valve 11 and the piston 3 moving downwards, mixture from the mixture preparation unit 14 is sucked into the combustion chamber 5 via the intake channel 13. In the compression stroke following the intake stroke the piston 3 moves upwards, wherein the inlet valve 11 as well as the outlet valve 12 are closed. Because of the upward-moving piston 3, a negative pressure is created in the crankcase interior 15 which, via the first channel 17 and the second channel 32, is also present in the valve drive chamber 16. Because of the negative pressure, mixture from the intake channel 13 is thus sucked via the connecting channel 49 into the valve drive chamber 16 and via the first channel 17 and the second channel 32 also into the crankcase interior 15. The sucked-in mixture serves for lubricating the moving parts such as for example the piston pin 7, the piston pin bearing 68, the valve control 57, the crankpin 24, the crankpin bearing 67 and the crankshaft bearings 66, which are shown in FIG. 9. Towards the end of the compression stroke, the ignition and thus the power stroke takes place during which the crankshaft 9 is driven. After the power stroke, the outlet valve 12 opens and the gases that are present in the combustion chamber 5 are expelled via an exhaust channel which is not shown.

In the following intake stroke, the piston 3 again moves downwards, as a result of which an overpressure is built up in the crankcase interior 15, which pushes the mixture sucked-in in the crankcase interior 15 from previous strokes via the first channel 17, the second channel 32, the valve drive chamber 16 and via the connecting channel 49 into the intake channel 13. From the intake channel 13, mixture enters the combustion chamber 5. With the following upward movement of the piston 3, the four-stroke process is repeated and the negative pressure created in the crankcase interior 15 again sucks in fresh mixture for lubrication from the intake channel 13.

Figure 3:
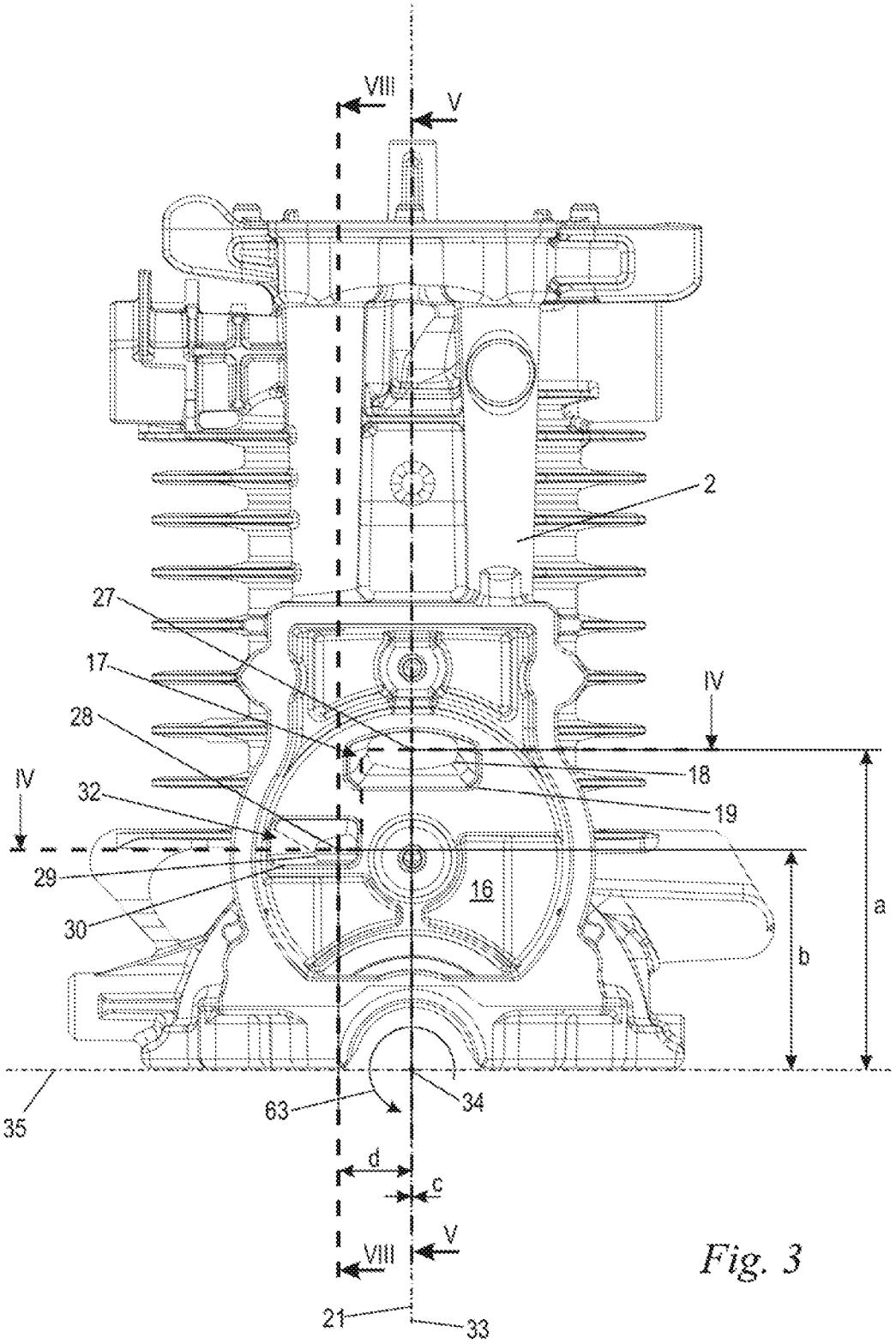
FIG. 3 shows a lateral view of the cylinder of the mixture-lubricated four-stroke engine.

In FIG. 3, a lateral view of the cylinder 2 from the side of the valve drive chamber 16 is shown. Drive elements such as the crankshaft 9 or the valve control 57 are not shown. FIG. 3 shows extracts of the valve drive chamber 16 and the first channel 17 extending from the valve drive chamber 16 into the crankcase interior 15 and the second channel 32. The first channel 17 in the embodiment is arranged in the cylinder 2 so that the center point 27 of the first opening 18 of the first channel 17 lies in the cylinder longitudinal plane 33. In an advantageous embodiment the first channel 17 can also be arranged so that in viewing direction of the rotational axis 34 the center point 27 of the first opening 18 of the first channel 17 is laterally offset relative to the cylinder longitudinal plane 33. The distance c between the center point 27 and the cylinder longitudinal plane 33 amounts to zero in the embodiment. The distance c advantageously amounts to less than 30%, in particular less than 20%, preferably less than 10% of half the piston stroke m. Half the piston stroke m is the absolute distance between the axis of rotation 34 and a center axis 64 of the crankpin 24 (FIG. 9). The center point 27 is at a distance a (FIG. 3) measured in the direction of the longitudinal center axis 21 to the crankshaft longitudinal plane 35 which advantageously amounts to at least twice, in particular at least 2.5 times, preferably 3 times, half the piston stroke m.

The crankshaft longitudinal plane 35 contains the rotational axis 34 and stands perpendicularly to the longitudinal center axis 21. The center point 28 of the first opening 29 of the second channel 32 advantageously is at a distance b from the crankshaft longitudinal plane 35 measured perpendicularly to the longitudinal center axis 21. The distance b is preferentially smaller or equal to the distance a of the center point 27 of the first opening 18 of the first channel 17. The distance b advantageously amounts to 0.5 times to 0.8 times the distance a. The center point 28 of the first opening 29 of the second channel 32 is at a distance d from the cylinder longitudinal plane 33 measured perpendicularly to the longitudinal center plane 33. In the embodiment, the second channel 32 in viewing direction of a plane standing perpendicularly relative to the longitudinal center plane 33, is arranged on the side of the cylinder longitudinal plane 33 on which the crankpin 24 is located during the downward stroke of the piston 3. In an advantageous embodiment, the second channel 32 can be arranged on the side of the cylinder longitudinal plane 33 on which the crankpin 24 is located during the upward stroke of the piston 3. Through the different arrangements of the first channel 17 and of the second channel 32, regions that are spaced relative to one another in the crankcase interior 15 can be specifically supplied with lubricant.

In a particularly advantageous embodiment, a third channel, in addition to the first channel 17 and the second channel 32, can extend between valve drive chamber 16 and crankcase interior 15. The third channel and the second channel 32 are advantageously arranged on opposite sides of the cylinder longitudinal plane 33. The distance d between the center point 28 and the cylinder longitudinal plane 33 is preferentially greater than the distance c between the center point 27 and the cylinder longitudinal plane 33. The distance d advantageously amounts to more than 40%, in particular more than 50%, preferably more than 60% of half the piston stroke m.

Figure 4:
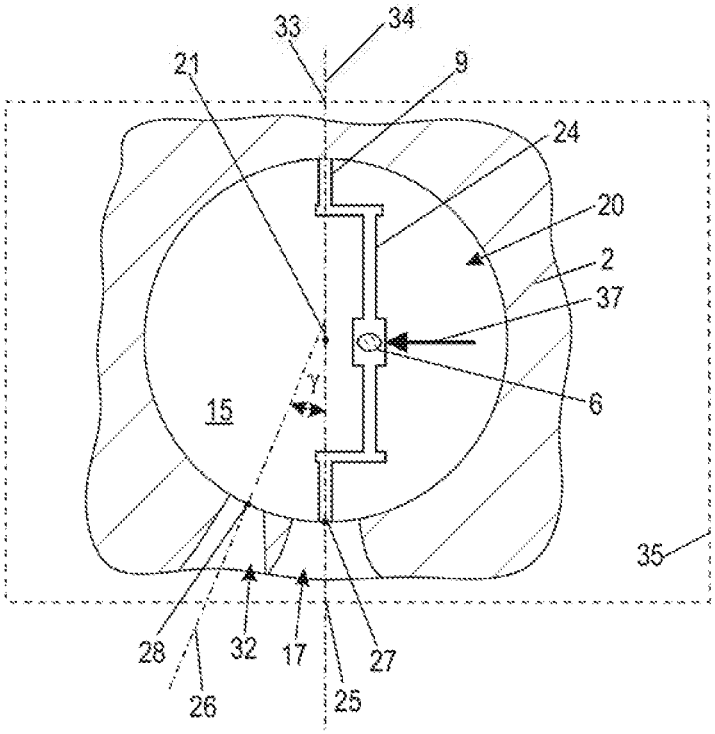
FIG. 4 shows a schematic sectional representation along the line IV-IV in FIG. 3 by way of an extract.

In the sectional representation of the four-stroke engine according to FIG. 1 shown in FIG. 4 in an extract, the piston 3 that is not shown is moving upwards. Thus, the piston performs a movement in the direction of the top dead center (TDC). The crankpin 24 of the crankshaft 9 moves in viewing direction perpendicular to the crankshaft longitudinal plane 35 perpendicularly to the cylinder longitudinal plane 33 in movement direction 37. In viewing direction of the longitudinal center axis 21, the first middle flow direction 25 extends through the center point 27 of the first opening 18 of the first channel 17 advantageously in parallel, in particular congruently regarding the rotational axis 34. The second middle flow direction 26 extends through the center point 28 of the first opening 29 of the second channel 32 and intersects the cylinder longitudinal plane 33 at an angle γ, wherein the angle γ is open towards the first channel 17 and towards the second channel 32. In the embodiment, the angle γ amounts to at least 10°, advantageously at least 15°, in particular at least 20°. In viewing direction of the longitudinal center axis 21, the second middle flow direction 26 is advantageously inclined towards the cylinder longitudinal plane 33 so that the flow of the mixture flowing through the second channel 32 into the crankcase interior 15 has a directional component in the top dead center which is directed against the movement direction 37 of the crankpin 24.

Figure 5:
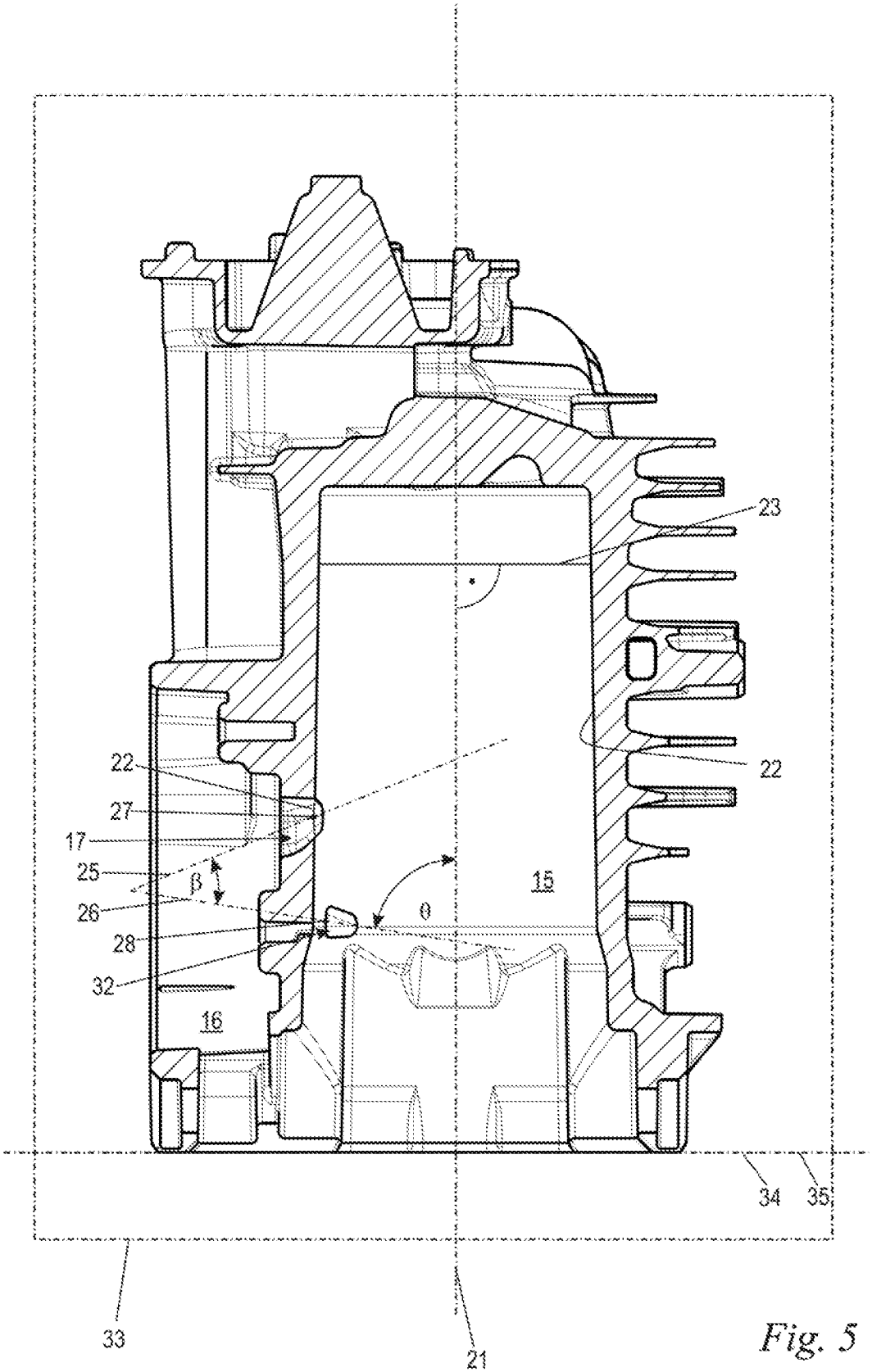
FIG. 5 shows a sectional representation along the line V-V in FIG. 3.

In FIG. 5 it is shown how the first channel 17 and the second channel 32 open into the crankcase interior 15. The second middle flow direction 26 extends in viewing direction perpendicular to the cylinder longitudinal plane 33 emanating from the valve drive chamber 16 through the center point 28 of the first opening 29 of the second channel 32 in the direction of the rotational axis 34. The second middle flow direction 26 in viewing direction perpendicular to the cylinder longitudinal plane 33 intersects the longitudinal center axis 21 at an angle θ, which opens towards the second channel 32 and towards the first channel 17. The angle θ between the second middle flow direction 26 and the longitudinal center axis 21 in the embodiment amounts to maximally 85°, in an advantageous embodiment maximally 80°.

As shown by FIG. 5, the first middle flow direction 25 intersects the second middle flow direction 26 at an angle β.

The angle β opens in viewing direction perpendicular to the cylinder longitudinal plane 33 in the direction towards the longitudinal center axis 21. The angle β in the embodiment amounts to at least 10°, advantageously at least 20°, in particular at least 30°.

In the viewing direction of FIG. 5, the first middle flow direction 25 extends upwards into the crankcase interior 15 and the second middle flow direction 26 downwards into the crankcase interior 15. Because of this, mixture in the embodiment flows in viewing direction perpendicular to the cylinder longitudinal plane 33 which corresponds to the viewing direction of FIG. 5, emanating from the valve drive chamber 16 through the first channel 17 upwards into the crankcase interior 15 and emanating from the valve drive chamber 16 through the second channel 32 downwards into the crankcase interior 15.

In FIG. 5 a first opening area 22 is shown. The first opening area 22 corresponds to the area content of the first opening 18. The first opening area 22 of the first channel 17 is larger than 5%, in particular approximately 7%, preferentially larger than 10%, advantageously larger than 15%, in particular larger than 20% of a cross-sectional area 23, standing perpendicularly relative to the longitudinal center axis 21, of the cylinder bore 20, which extends parallel to the crankshaft longitudinal plane 35. The first opening area 22 of the first channel 17 can advantageously be smaller than 10%, in particular smaller than 7% of the cross-sectional area 23 of the cylinder bore 20. In the embodiment, the cross-sectional area 23 amounts to approximately 2,000 $mm^2$.

Figure 6:
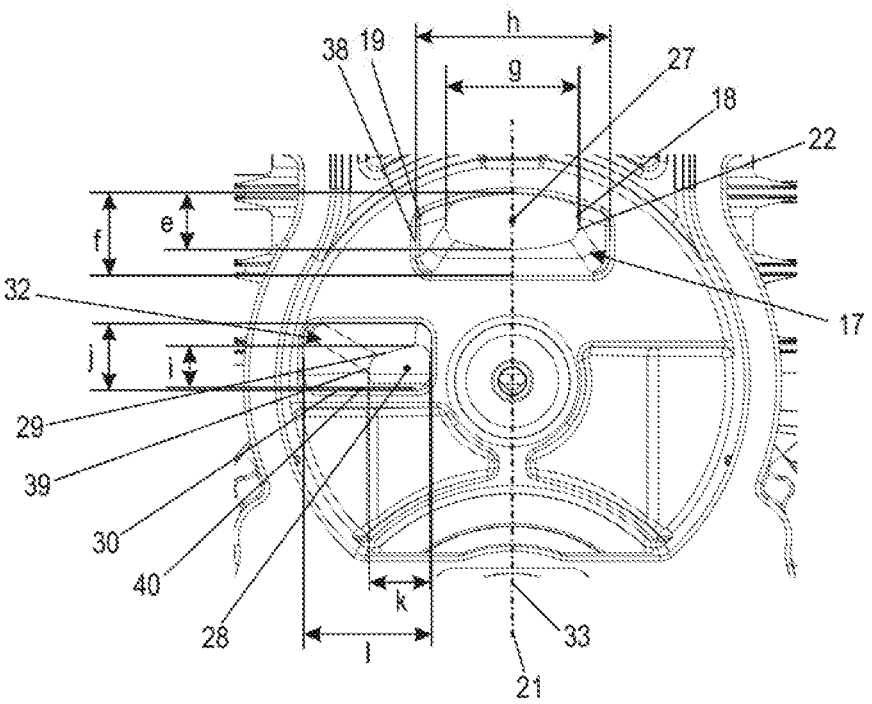
FIG. 6 shows a representation of the valve drive chamber from FIG. 3 by way of an extract.

In FIG. 6, the first channel 17 and the second channel 32 are shown. The first opening 18 of the first channel 17 has a width g measured perpendicularly to the cylinder longitudinal plane 33 and a height e measured in the direction of the longitudinal center plane 21. The second opening 19 of the first channel 17 has a width h measured perpendicularly to the cylinder longitudinal plane 33 and a height f measured in the direction of the longitudinal center axis 21. The height e of the first opening 18 is advantageously smaller than the height f of the second opening 19. The width g of the first opening 18 is advantageously smaller than the width h of the second opening 19. For this reason, the first opening area 22 of the first channel 17 is advantageously smaller than a second opening area 38 of the first channel 17. The second opening area 38 of the first channel 17 corresponds to the area content of the second opening 19.

The first opening 29 of the second channel 32 has a width k measured perpendicularly to the cylinder longitudinal plane 33 and a height i measured in the direction of the longitudinal center plane 21. The second opening 30 of the second channel 32 has a width 1 measured perpendicularly to the cylinder longitudinal plane 33 and a height j measured in the direction of the longitudinal center axis 21. The height i of the first opening 29 is advantageously smaller than the height j of the second opening 30. The width k of the first opening 29 is advantageously smaller than the width 1 of the second opening 30. For this reason, a first opening area 39 of the second channel 32 is advantageously smaller than a second opening area 40 of the second channel 32. The first opening area 39 of the second channel 32 corresponds to the area content of the first opening 29 of the second channel 32. The second opening area 40 of the second channel 32 corresponds to the area content of the second opening 30 of the second channel 32.

The first channel 17 tapers from its second opening 19 as far as to its first opening 18. The second channel 32 also tapers from its second opening 30 as far as to its first opening 29. Because of this, mixture while flowing from the valve drive chamber 16 into the crankcase interior 15 is accelerated both in the first channel 17 and also in the second channel 32 in the direction of the crankcase interior 15. The flow velocity of the mixture is greater in each case at the first opening 18, 29 of one of the channels 17, 32 than the flow velocity at the second opening 19, 30 of this channel 17, 32.

The second opening area 38 of the first channel 17 is greater than 5%, in particular greater than 10%, preferentially approximately 11% of the cross-sectional area 23 of the cylinder bore 20. The second opening area 38 of the first channel 17 is advantageously smaller than 20%, in particular smaller than 15% of the cross-sectional area 23 of the cylinder bore 20.

The first opening area 39 of the second channel 32 is greater than 1%, in particular approximately 2% of the cross-sectional area 23 of the cylinder bore 20. The first opening area 39 of the second channel 32 is advantageously smaller than 10%, in particular smaller than 5% of the cross-sectional area 23 of the cylinder bore 20.

The second opening area 40 of the second channel 32 is greater than 5%, in particular approximately 7% of the cross-sectional area 23 of the cylinder bore 20. The second opening area 40 of the second channel 32 is advantageously smaller than 10% of the cross-sectional area 23 of the cylinder bore 20.

Figure 7:
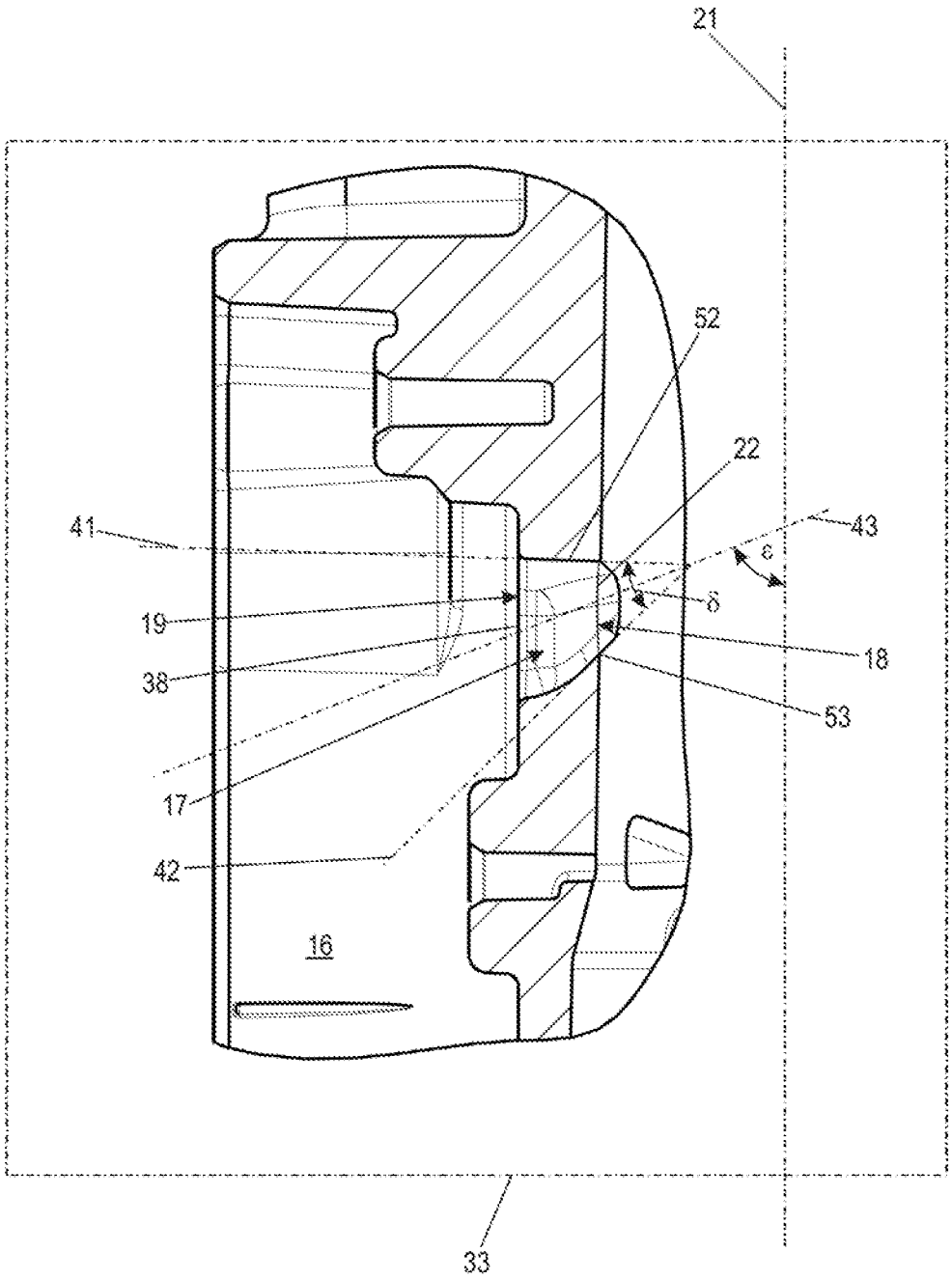
FIG. 7 shows a sectional representation along the line V-V in FIG. 3 by way of an extract.

In FIG. 7, a section through the center point 27 of the first channel 17 is shown. In viewing direction perpendicular to the cylinder longitudinal plane 33, an upper profile edge 52 and a lower profile edge 53 of the first channel 17 are shown, wherein the upper profile edge 52 is at a distance from the rotational axis 34 measured in the direction of the longitudinal center axis 21 that is greater than the lower profile edge 53 of the first channel 17. An upper tangent 41 lies against the upper profile edge 52 in the first opening 18 of the first channel 17, a lower tangent 42 lies against the lower profile edge 53 in the first opening 18 of the first channel 17. The upper tangent 41 and the lower tangent 42 of the first channel 17 intersect in the viewing direction perpendicular to the cylinder longitudinal plane 33 at an angle δ which is open towards the first channel 17. In the embodiment, the angle δ amounts to at least 20°, advantageously at least 30°, in particular at least 40°. The upper tangent 41 and the lower tangent 42 of the first channel 17 have an angle bisector 43. The angle bisector 43 includes an angle ε with the longitudinal center axis 21 in viewing direction of the cylinder longitudinal plane 33. The angle bisector 43 approximately corresponds to the middle flow direction 25 of the first channel 17. The angle ε is open in the direction of the rotational axis 34 and in the direction of the first channel 17 and in the embodiment amounts to maximally 85°, advantageously maximally 75°, in particular maximally 70°.

Figure 8:
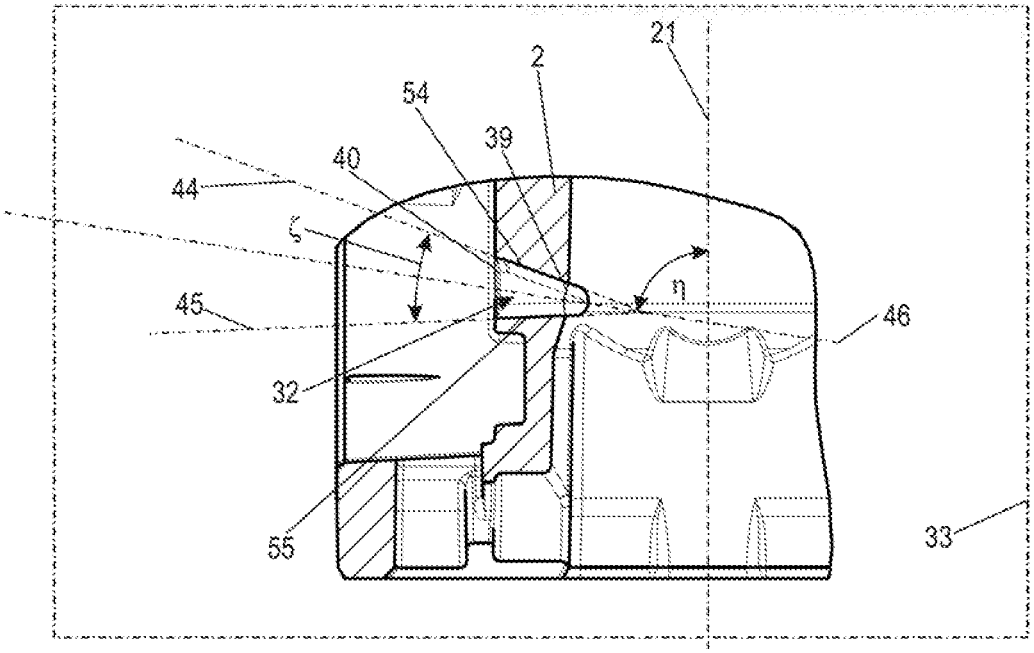
FIG. 8 shows a sectional representation along the line VIII-VIII in FIG. 3 by way of an extract.

In FIG. 8, a section through the center point 28 of the second channel 32 is shown. In viewing direction of FIG. 8, an upper profile edge 54 and a lower profile edge 55 of the second channel 32 are shown, wherein the upper profile edge 54 is at a distance from the rotational axis 34 measured in the direction of the longitudinal center axis 21 that is greater than the lower profile edge 55 of the second channel 32. An upper tangent 44 lies against the upper profile edge 54 in the first opening 29 of the second channel 32. A lower tangent 45 lies against the lower profile edge 55 in the first opening 29 of the second channel 32. The upper tangent 44 and the lower tangent 45 of the second channel 32 intersect in the viewing direction perpendicular to the cylinder longitudinal plane 33 at an angle which is open towards the second channel 32. In the embodiment, the angle amounts to at least 10°, advantageously at least 15°, in particular at least 20°. The upper tangent 44 and the lower tangent 45 of the second channel 32 have an angle bisector 46. The angle bisector 46 includes an angle η with the longitudinal center axis 21 in viewing direction of the cylinder longitudinal plane 33. The angle bisector 46 approximately corresponds to the middle flow direction 26 of the second channel 32. The angle η is open in the direction of the combustion chamber 5 and in the direction of the second channel 32 and in the embodiment amounts to at least 70°, advantageously at least 80°, in particular at least 85°.

In FIG. 9, a sectional representation of the mixture-lubricated four-stroke engine 1 is shown. In the representation of the four-stroke engine 1 shown in FIG. 9, the piston 3 is in the bottom dead center. At its piston pin 7, the piston 3 is connected via a piston pin bearing 68 to the connecting rod 6, wherein the connecting rod 6 is connected to the crankshaft in an articulated manner via a crankpin bearing 67. The piston 3 drives the crankshaft 9, wherein the crankshaft 9 is arranged mounted in the crankcase 8. The crankshaft 9 drives the valve control 57 in the valve drive chamber 16 via a toothed wheel 65 mounted on the crankshaft 9 and arranged in the valve drive chamber 16. The first middle flow direction 25 advantageously intersects the longitudinal center axis 21 at an angle α and extends through the space 47 enclosed by the piston 3 and the combustion chamber 5. The second middle flow direction 26, emanating from the second channel 32, extends inclined through the crankcase interior 15 in the direction towards the crankshaft longitudinal plane 35. The second middle flow direction 26 advantageously intersects a crank web 62 of the crankshaft 9. The first middle flow direction 25 of the first channel 17 advantageously intersects the second middle flow direction 26 of the second channel 32 at the angle β in the bottom dead center of the piston 3.

The crankshaft 9 is rotatably mounted in crankshaft bearings 66 in the crankcase 8. In an advantageous embodiment, a seal 69 is arranged on the crankshaft bearing 66 between crankcase interior 15 and valve drive chamber 16, in particular a seal 69 formed on the crankshaft bearing 66 which prevents the mixture flowing through the crankshaft bearing 66. The seal 69 is schematically shown in FIG. 9. The tighter the crankshaft bearing 66 is formed between crankcase interior 15 and valve drive chamber 16, the more effectively are the moving parts in the crankcase interior 15 subjected to mixture inflow and lubrication via the first channel 17 and the second channel 32.

Figure 10:
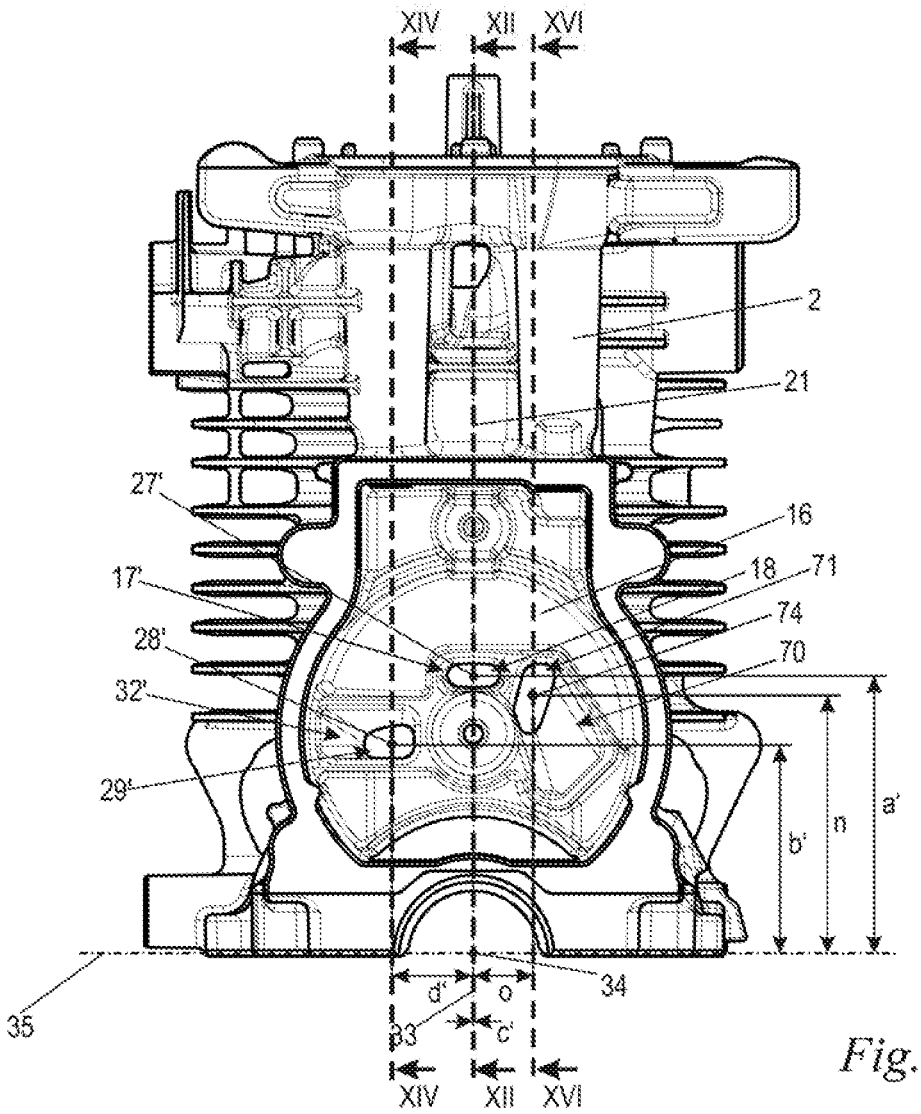
FIG. 10 shows a lateral view of the cylinder of a mixture-lubricated four-stroke engine with three flow channels.

In FIG. 10, a further embodiment of the mixture-lubricated four-stroke engine 1 is shown. Identical reference characters mark elements which correspond to one another in all figures. The crankcase interior 15 is flow-connected to the valve drive chamber 16 via a first channel 17', a second channel 32' and a third channel 70. Accordingly, the crankcase interior 15 is flow-connected via the first channel 17', the second channel 32' and the third channel 70 to the valve drive chamber 16, the connecting channel 49, the intake channel 13 and the mixture preparation unit 14. In at least one piston position, a negative pressure is present in the crankcase interior 15 such that mixture from the intake channel 13 is sucked into the crankcase interior 15 via the connecting channel 49 and the valve drive chamber 16 through the first channel 17', the second channel 32' and the third channel 70. Such a negative pressure is present in particular when the piston 3 is in the upward stroke.

The third channel 70 opens with a first opening 71 into the crankcase interior 15 and with a second opening 72 into the valve drive chamber 16. In viewing direction of FIG. 16, a center line 73 of the third channel 70 extends from its second opening 72 obliquely upwards to its first opening 71. The center line 73 connects centroids of sectional areas of the third channel 70 in planes standing perpendicularly to the rotational axis 34. The first opening 71 of the third channel 70 has a geometrical center point 74 at which the mixture during the operation flows in a third middle flow direction 75. The third middle flow direction 75 in this case is a straight line which extends through the center point 74 of the first opening 71 of the third channel 70 and in the embodiment is approximated to the center line 73 of the third channel 70. The third middle flow direction 75 extends in viewing direction of FIG. 16 perpendicularly onto the cylinder longitudinal plane 33 emanating from the valve drive chamber 16 through the third channel 70 obliquely upwards in the direction of the combustion chamber 5. The third middle flow direction 75 in the embodiment intersects the longitudinal center axis 21 above the first opening 71 of the third channel 70.

Figure 11:
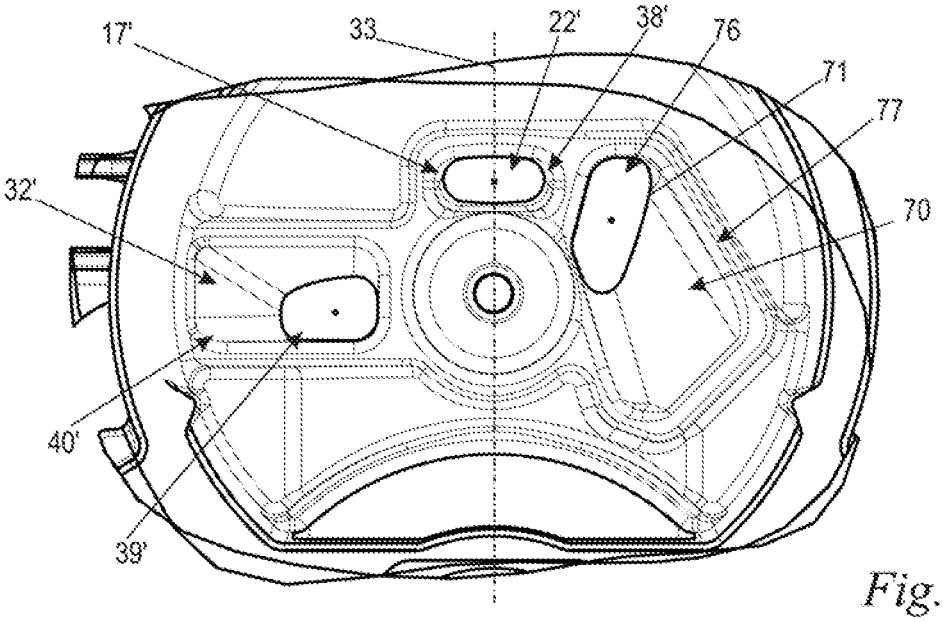
FIG. 11 shows an enlarged representation of the channels from FIG. 10 by way of an extract.
Figure 12:
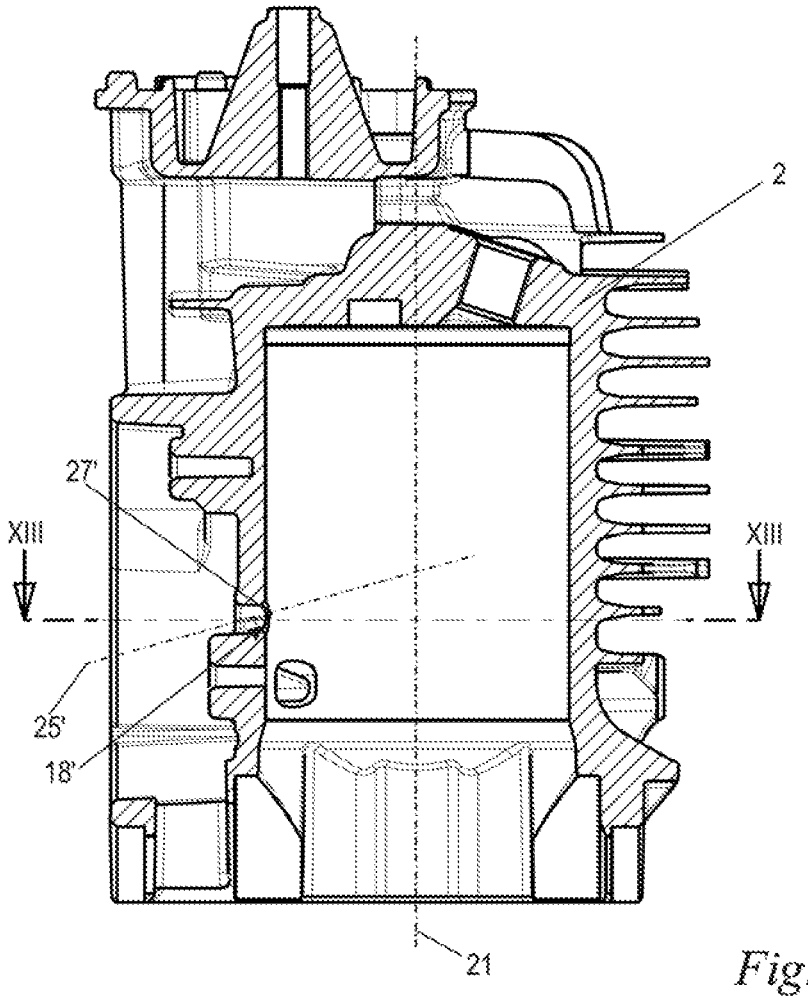
FIG. 12 shows a sectional representation along the line XII-XII in FIG. 10.
Figure 13:
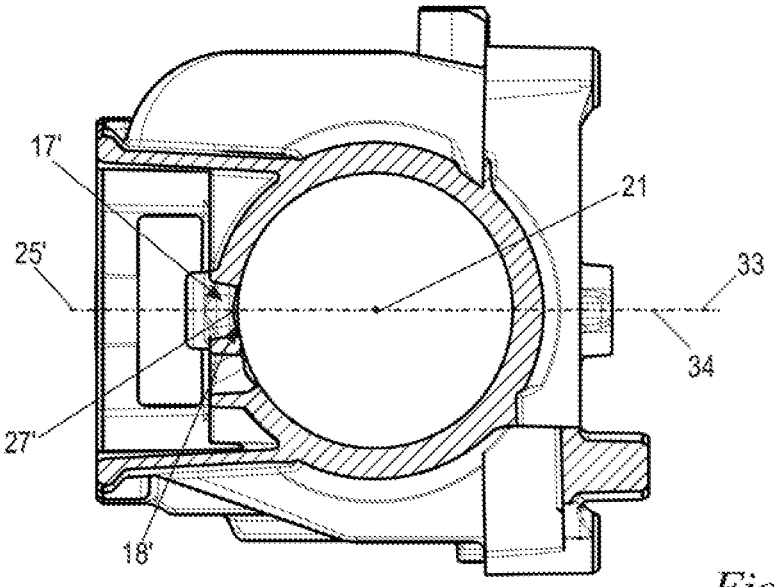
FIG. 13 shows a sectional representation along the line XIII-XIII in FIG. 12.
Figure 14:
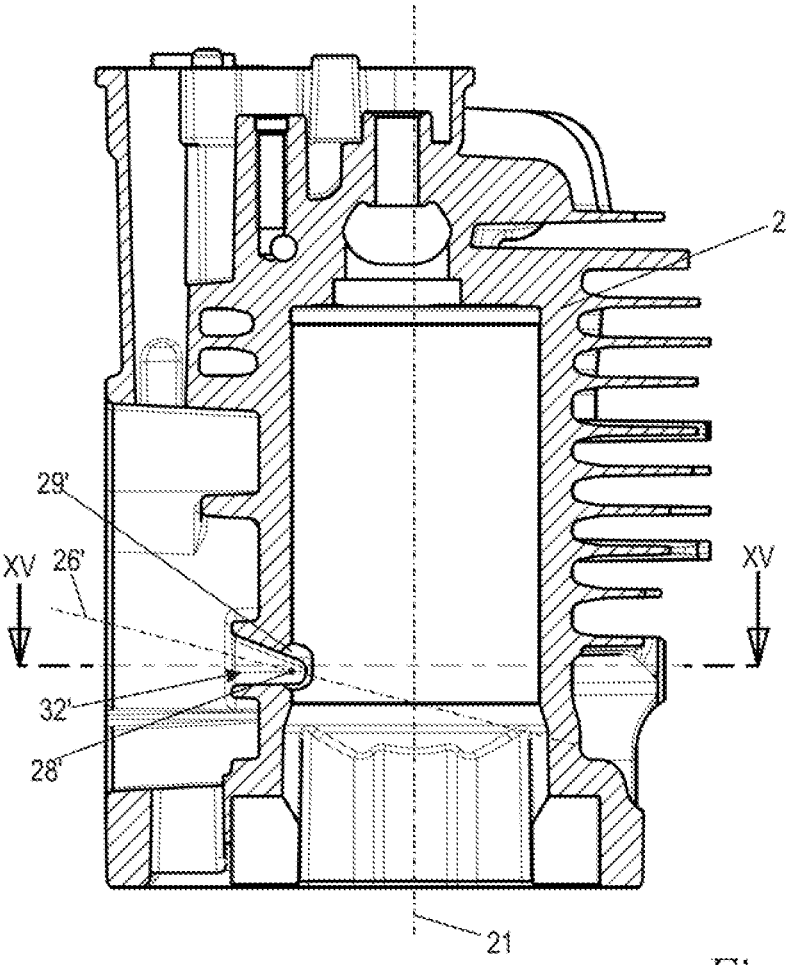
FIG. 14 shows a sectional representation along the line XIV-XIV in FIG. 10.
Figure 15:
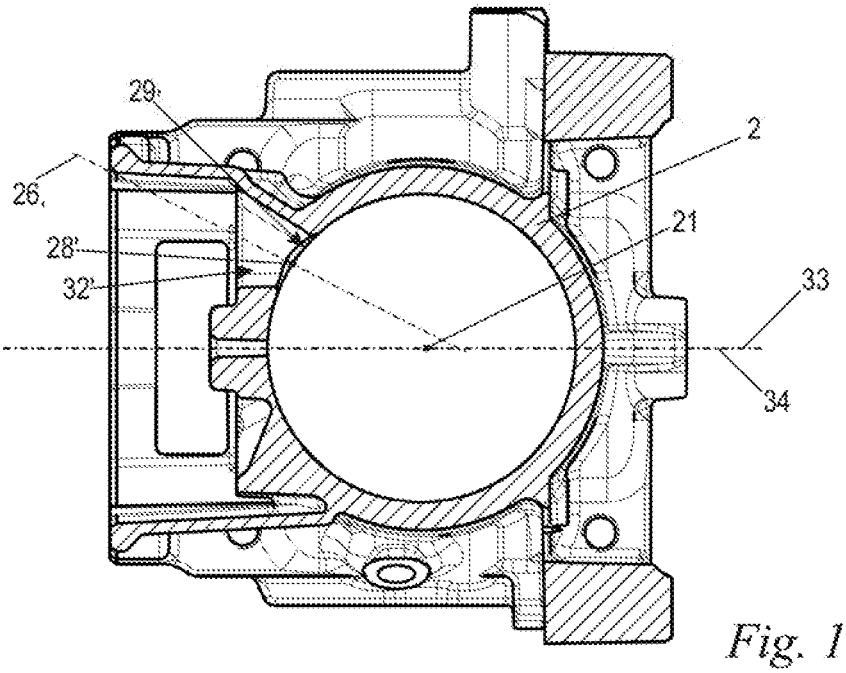
FIG. 15 shows a sectional representation along the line XV-XV in FIG. 14.

As shown in FIGS. 10 and 11, the third channel 70 and the second channel 32' in the embodiment are arranged on opposite sides of the cylinder longitudinal plane 33. The center point 74 of the first opening 71 of the third channel 70 is at a distance n from the crankshaft longitudinal plane 35 and at a distance o from the cylinder longitudinal plane 33. The distance o in the embodiment is smaller than the distance d' between the center point 28' and the cylinder longitudinal plane 33 and greater than the distance c' between the center point 27' and the cylinder longitudinal plane 33. The distance d' advantageously amounts to more than 40%, in particular more than 50%, preferably more than 60% of half the piston stroke m. The distance c' between the center point 27' and the cylinder longitudinal plane 33 in the embodiment is zero. The distance c' advantageously amounts to less than 30%, in particular less than 20%, preferably less than 10% of half the piston stroke m.

As shown in FIG. 10, the distance a' between the center point 27' and the crankshaft longitudinal plane 35 measured in the direction of the longitudinal center axis 21 advantageously amounts to at least twice, in particular at least 2.5 times, preferably 3 times half the piston stroke m. The distance b' between the center point 28' of the first opening 29' of the second channel 32' and the crankshaft longitudinal plane 35 is preferentially smaller or equal to the distance a of the center point 27' of the first opening 18' of the first channel 17'. The distance b' advantageously amounts to 0.5 times to 0.8 times the distance a'. In the embodiment, the distance n is greater than the distance b' and smaller than the distance a'.

In FIG. 11, a first opening area 76 of the third channel 70 is shown. The first opening area 76 corresponds to the area content of the first opening 71 of the third channel 70. The first opening area 76 of the third channel 70 is greater than 1%, in particular approximately 3% of the cross-sectional area 23 of the cylinder bore 20. The first opening area 76 of the third channel 70 is advantageously smaller than 10%, in particular smaller than 5% of the cross-sectional area 23 of the cylinder bore 20. In the embodiment, the cross-sectional area 23 amounts to approximately 2,000 $mm^2$. The third channel 70 has a second opening area 77 which corresponds to the area content of the second opening 72 of the third channel 70. The second opening area 77 of the third channel 70 is greater than 5%, in particular greater than 10%, preferentially approximately 11% of the cross-sectional area 23 of the cylinder bore 20. The second opening area 77 of the third channel 70 is smaller than 20%, in particular smaller than 15% of the cross-sectional area 23 of the cylinder bore 20.

The first opening area 22' of the first channel 17' is greater than 1%, in particular approximately 1.5% of the cross-sectional area 23 of the cylinder bore 20. The first opening area 22' of the first channel 17' is advantageously smaller than 10%, in particular smaller than 5% of the cross-sectional area 23 of the cylinder bore 20.

The second opening area 38' of the first channel 17' is greater than 1%, in particular approximately 2.5% of the cross-sectional area 23 of the cylinder bore 20. The second opening area 38' of the first channel 17' is advantageously smaller than 10%, in particular smaller than 5% of the cross-sectional area 23 of the cylinder bore 20.

The first opening area 39' of the second channel 32' is greater than 1%, in particular approximately 1.3% of the cross-sectional area 23 of the cylinder bore 20. The first opening area 39' of the second channel 32' is advantageously smaller than 10%, in particular smaller than 5% of the cross-sectional area 23 of the cylinder bore 20.

The second opening area 40' of the second channel 32' is greater than 5%, in particular approximately 6.5% of the cross-sectional area 23 of the cylinder bore 20. The second opening area 40' of the second channel 32' is advantageously smaller than 15%, in particular smaller than 10% of the cross-sectional area 23 of the cylinder bore 20.

The channels 17', 32', 70 taper from their second opening 19', 30', 72 as far as to their first opening 18', 29', 71. Because of this, mixture is accelerated in the channels 17', 32', 70 in the direction of the crankcase interior 15 while flowing from the valve drive chamber 16 into the crankcase interior 15. The flow velocity of the mixture in each case is greater at the first opening 18', 29', 71 than at the second opening 19', 30', 72.

As shown in FIGS. 12 to 15, the first channel 17' and the second channel 32' are formed similarly to the first embodiment according to FIG. 3, according to which for the middle flow directions 25', 26' the same angular conditions $\alpha$, $\beta$, $\gamma$, $\theta$ apply.

Figure 16:
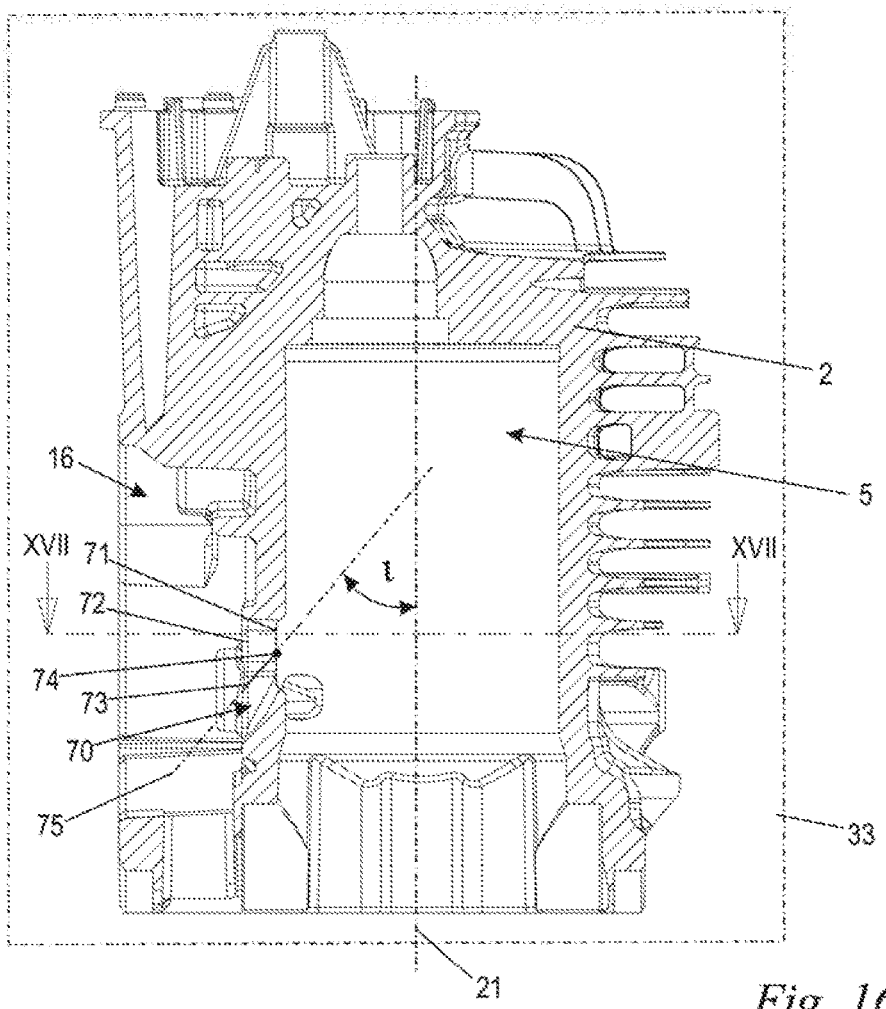
FIG. 16 shows a sectional representation along the line XVI-XVI in FIG. 10; and, FIG. 17 shows a sectional representation along the line XVII-XVII in FIG. 16.

As shown in FIG. 16, the third middle flow direction 75 in a viewing direction perpendicular onto the cylinder longitudinal plane 33 includes with the longitudinal center axis 21 an angle $\iota$ of maximally 85°, in an advantageous embodiment of maximally 70°, in particular of 40°. The angle $\iota$ is open towards the third channel 70 and towards the rotational axis 34. Consequently, the third middle flow direction 75 extends upwards in the direction of the combustion chamber 5. Because of this, the third channel 75 is oriented in such a manner that during the operation of the mixture-lubricated four-stroke engine 1 in the region of the top dead center of the piston 3 the mixture flows from the valve drive chamber 16 through the first channel 17 into the crankcase interior 15 aimed against the piston pin 7. Because of this, the piston pin and the piston pin bearing are subjected to a flow of lubricant and are suitably supplied with lubricant through the first channel 17' and also through the third channel 70.

Figure 17:
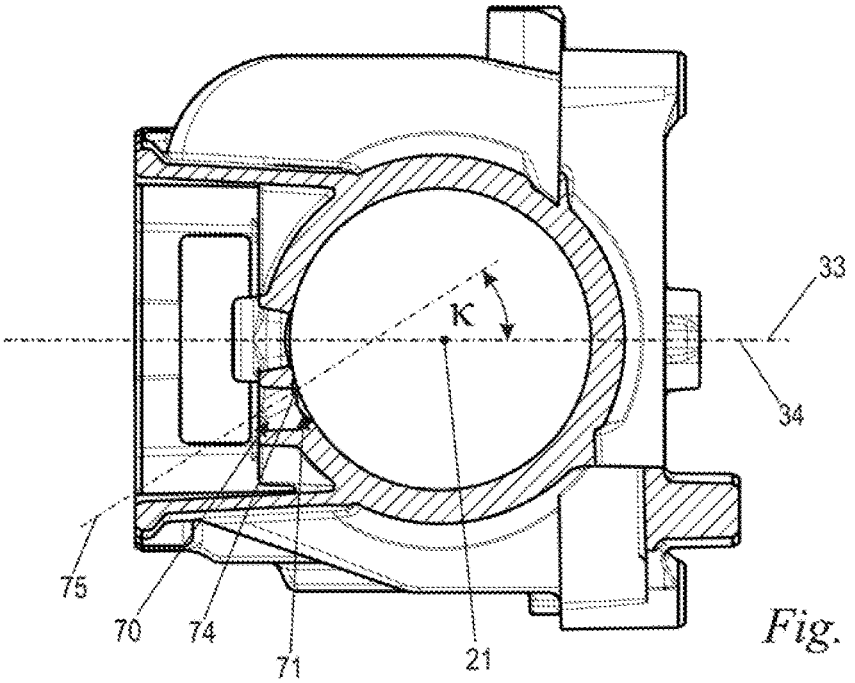

As shown in FIG. 17, the third middle flow direction 75 extends through the center point 74 of the first opening 71 of the third channel 70 and intersects the cylinder longitudinal plane 33 at an angle $\kappa$, wherein the angle $\kappa$ is open towards the third channel 70 and towards the first channel 17. In the embodiment, the angle $\kappa$ amounts to at least 10°, advantageously at least 15°, in particular 30°.

It is understood that the foregoing description is that of the preferred embodiments of the invention and that various changes and modifications may be made thereto without departing from the spirit and scope of the invention as defined in the appended claims.

What is claimed is:

1. A mixture-lubricated four-stroke engine comprising:
a cylinder;
a piston;
at least one piston ring arranged on said piston;
said cylinder and said piston conjointly delimiting a combustion chamber;
a piston pin;
a crankpin;
a connecting rod mounted on said piston pin and said crankpin;
a crankcase defining a crankcase interior;
a crankshaft arranged in said crankcase interior and defining a crankshaft axis;
said piston being configured to drive said crankshaft via said connecting rod;
an inlet valve;
an outlet valve;
a valve control for said inlet valve and said outlet valve;
said crankshaft being configured to drive said valve control for said inlet valve and said outlet valve;
a mixture preparation unit for preparing a mixture;
an intake channel for receiving said mixture;
said inlet valve being connected to said mixture preparation unit via said intake channel;
a valve drive chamber;
said crankcase interior being flow-connected to said intake channel via said valve drive chamber;
at least one first channel being part of the flow-connection and being arranged between said valve drive chamber and said crankcase interior so as to permit said mixture to flow from said intake channel through said valve drive chamber and via said at least one first channel into said crankcase interior in response to an underpressure in said crankcase interior;
said at least one first channel defining a first opening which opens into said crankcase interior and a second opening which opens into said valve drive chamber;
said cylinder having a cylinder bore defining a longitudinal center axis;
said longitudinal center axis and said crankshaft axis conjointly defining a cylinder longitudinal plane;
said piston having a bottom dead center position;
said first opening of said at least one first channel lying below each of said at least one piston ring in said bottom dead center position of said piston;
said at least one first channel, at said first opening, defining a first middle flow direction for mixture flowing into said crankcase interior; and,
said first middle flow direction extending inclined towards said combustion chamber and, in a viewing direction perpendicular to said cylinder longitudinal plane, intersecting said longitudinal center axis above said first opening of the at least one first channel.

2. The four-stroke engine of claim 1, wherein, in the viewing direction perpendicular to said cylinder longitudinal plane, said first middle flow direction encloses an angle a of at most 85° with said longitudinal center axis.

3. The four-stroke engine of claim 1, wherein said piston includes a piston skirt; and, said first middle flow direction in said bottom dead center position of said piston extends through a space enclosed by said piston skirt.

4. The four-stroke engine of claim 1, wherein said piston has a piston bottom; and, said first middle flow direction intersects said piston bottom in said bottom dead center position of said piston.

5. The four-stroke engine of claim 1, wherein:

said piston has a top dead center position; and, said first middle flow direction intersects said piston pin in said top dead center position of said piston causing said piston pin to be lubricated by said mixture.

6. The four-stroke engine of claim 1, wherein, in at least one piston position, said underpressure in said crankcase interior is such that mixture from said intake channel is drawn in via said valve drive chamber through said at least one first channel into said crankcase interior.

7. The four-stroke engine of claim 1, wherein:

said at least one first channel has a first opening area at said first opening; and, said first opening area is greater than 5% of a cross-sectional area of said cylinder bore disposed perpendicularly relative to said longitudinal center axis.

8. The four-stroke engine of claim 1, wherein said at least one first channel, starting from said second opening of said at least one first channel, tapers towards said first opening of said at least one first channel.

9. The four-stroke engine of claim 1 further comprising:

a second channel having a first second channel opening and a further second channel opening;

said crankcase interior and said valve drive chamber being flow-connected by said second channel; and, wherein said first second channel opening of said second channel opens into said crankcase interior and said further second channel opening opens into said valve drive chamber.

10. The four-stroke engine of claim 9, wherein:

said second channel, at a center point of said first second channel opening, defines a second middle flow direction; and, said first middle flow direction and said second middle flow direction, in a viewing direction perpendicular to said cylinder longitudinal plane, enclose an angle $\beta$ of at least 10° .

11. The four-stroke engine of claim 9, wherein:

said second channel, at a center point of said first second channel opening, defines a second middle flow direction; said piston has a top dead center position; and, said second middle flow direction, in said top dead center position of said piston, intersects said crankpin.

12. The four-stroke engine of claim 9, wherein:

said first opening of said first channel has a first center point;

said first second channel opening of said second channel has a second center point; and, said first center point is at a shorter distance from said cylinder longitudinal plane than said second center point.

13. The four-stroke engine of claim 9, wherein:

said first opening of said first channel has a first center point;

said first second channel opening of said second channel has a second center point;

said crankshaft defines a crankshaft longitudinal plane disposed perpendicularly relative to said longitudinal center axis and containing said crankshaft axis; and, a distance of said crankshaft longitudinal plane to said first center point of the first opening of the first channel is greater than to said second center point.

14. A mixture-lubricated four-stroke engine comprising:

a cylinder;

a piston;

at least one piston ring arranged on said piston;

said cylinder and said piston conjointly delimiting a combustion chamber;

a piston pin;

a crankpin;

a connecting rod mounted on said piston pin and said crankpin;

a crankcase defining a crankcase interior;

a crankshaft arranged in said crankcase interior and defining a crankshaft axis;

said piston being configured to drive said crankshaft via said connecting rod;

an inlet valve;

an outlet valve;

a valve control for said inlet valve and said outlet valve;

said crankshaft being configured to drive said valve control for said inlet valve and said outlet valve;

a mixture preparation unit;

an intake channel;

said inlet valve being connected to said mixture preparation unit via said intake channel;

a valve drive chamber;

said crankcase interior being flow-connected to said intake channel via said valve drive chamber;

at least one first channel being part of the flow-connection and being arranged between said valve drive chamber and said crankcase interior;

said at least one first channel defining a first opening which opens into said crankcase interior and a second opening which opens into said valve drive chamber;

said cylinder having a cylinder bore defining a longitudinal center axis;

said longitudinal center axis and said crankshaft axis conjointly defining a cylinder longitudinal plane;

said piston having a bottom dead center position;

said first opening of said at least one first channel lying below each of said at least one piston ring in said bottom dead center position of said piston;

said at least one first channel, at said first opening, defining a first middle flow direction for mixture flowing into said crankcase interior;

said first middle flow direction extending inclined towards said combustion chamber and, in a viewing direction perpendicular to said cylinder longitudinal plane, intersecting said longitudinal center axis above said first opening of the at least one first channel;

a second channel having a first second channel opening and a further second channel opening;

said crankcase interior and said valve drive chamber being flow-connected by said second channel;

wherein said first second channel opening of said second channel opens into said crankcase interior and said further second channel opening opens into said valve drive chamber; and, wherein:

said piston has a top dead center position;

said crankshaft defines a crankshaft longitudinal plane disposed perpendicularly relative to said longitudinal center axis and containing said crankshaft axis;

said second channel, at a center point of said first second channel opening, defines a second middle flow direction; and, said second middle flow direction in the viewing direction perpendicular to the crankshaft longitudinal plane is inclined relative to said cylinder longitudinal plane in such a manner that a flow of the mixture flowing through said second channel into said crankcase interior has a directional component in the top dead center position which is directed against a movement direction of said crankpin.

15. The four-stroke engine of claim 1 further comprising:

a seal;

a crankshaft bearing arranged in said crankcase between said crankcase interior and said valve drive chamber; and;

said crankshaft bearing being sealed via said seal.

16. The four-stroke engine of claim 9 further comprising:

a third channel having a first third channel opening and a further third channel opening;

said crankcase interior and said valve drive chamber being flow-connected by said third channel; and, wherein said first third channel opening opens into said crankcase interior and said further third channel opening opens into said valve drive chamber.

* * * * *